US006612126B2

(12) United States Patent
Kawasumi et al.

(10) Patent No.: US 6,612,126 B2
(45) Date of Patent: Sep. 2, 2003

(54) ICE MAKING MACHINE

(75) Inventors: Masaaki Kawasumi, Shimane-ken (JP); Masahiro Kodani, Izumo (JP); Shinichi Nagasawa, Izumo (JP); Chiyoshi Toya, Nagoya (JP); Shinsaku Hayakawa, Nagoya (JP)

(73) Assignee: Hoshizaki Denki Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/846,230

(22) Filed: May 2, 2001

(65) Prior Publication Data

US 2001/0054295 A1 Dec. 27, 2001

(30) Foreign Application Priority Data

May 2, 2000 (JP) ..... 2000-133653
Apr. 25, 2001 (JP) ..... 2001-128180

(51) Int. Cl.[7] ..... F25C 1/12
(52) U.S. Cl. ..... 62/347; 220/4.33
(58) Field of Search ..... 62/347; 220/4.33

(56) References Cited

U.S. PATENT DOCUMENTS 2,729,070 A 1/1956 Ames ..... 62/347
2,978,882 A 4/1961 Bollefer ..... 62/347
3,043,117 A * 7/1962 Bollefer ..... 62/344
3,236,405 A * 2/1966 Reil ..... 220/23.4
3,266,656 A * 8/1966 Kridle ..... 220/4.28
3,289,430 A * 12/1966 Dedricks et al. ..... 239/567
3,386,258 A * 6/1968 Zygiel ..... 165/168
3,407,621 A 10/1968 Dedricks et al. ..... 62/188
5,381,915 A * 1/1995 Yardley ..... 206/600

FOREIGN PATENT DOCUMENTS

GB 2021 746 A 12/1979
WO WO 94/01333 * 1/1994 ..... 220/4.33

* cited by examiner

*Primary Examiner*—William E. Tapolcai
(74) *Attorney, Agent, or Firm*—Arent Fox Kintner Plotkin & Kahn, PLLC

(57) ABSTRACT

An ice making machine of the open-cell type including a box-type housing, a water storage tank mounted to the bottom of the housing, a sprinkler mounted within the bottom portion of the housing and having a plurality of nozzles for spouting upward ice making water supplied to the water storage tank, and a plurality of ice making cell casings mounted wit an ice making chamber formed in an upper portion of the housing and located above the nozzles of the sprinkler to supplied with the ice making water spouted therefrom, wherein the box-type housing is composed of a pair of spaced side wall panels and front and rear wall panels jointed at their opposite side ends to front and rear end portions of the side wall panels respectively.

8 Claims, 10 Drawing Sheets

ICE MAKING MACHINE

BACKGROUND OF THE INVENTION

1. Field of the Invention

The present invention relates to an ice making machine, more particularly to an improvement of a housing assembly of the ice mating machine.

2. Discussion of the Prior Art

Illustrated in FIG. 18 is a conventional automatic ice making machine of the open-cell type which includes a box-type housing 1 composed of a pair of side wall panels 1*a* integrally formed with front and rear wall panels 1*c* and 1*b*, a water storage tank 2 mounted to the bottom of housing 1, a sprinkler 3 mounted on the bottom plate of housing 1 for spouting ice making water from its nozzles 3*a*, and a plurality of ice making cell casings 4*b* mounted within an ice making chamber 4 formed in an upper portion of housing 1. An inclined ice chute 6 is placed in the interior of housing 1, and a shutter 7 is suspended from the front wall panel 1*c* of housing 1 at a lower side of the ice chute 6.

A cooling pipe 5 meanderingly mounted on an upper plate 4*a* of ice making chamber 4 is connected to a refrigerant conduit 10 to be supplied with refrigerant from a freezing circuit including a compressor 11, a condenser 12 cooled by a cooling fan 13, a dehydrator 14 and an expansion valve 15. In the freezing circuit, a hot-gas valve 16 is provided in parallel with the condenser 12, dehydrator 14 and expansion valve 15. When the freezing circuit is activated in a condition where the hot-gas valve has been closed, the ice making chamber 4 is cooled by the refrigerant supplied into the cooling pipe 5 from the freezing circuit. When the expansion valve 15 is closed while the hot-gas valve 16 is being opened, the refrigerant is compressed by the compressor 11 and supplied as hot-gas into the cooling pipe 5.

The ice making water W in water storage tank 2 is supplied into the sprinkler 3 by operation of a water pump (not shown), spouted upward from each nozzle 3*a* through openings of ice chute 6 in the form of a lattice and brought into contact with the internal surface of each ice making cell casing 4*b* cooled by the refrigerant supplied from the freezing circuit. Thus, the ice making water is party frozen in each cell casing 4*b*, and a remainder of the water is returned into the water storage tank 2. The ice cubes formed in the cell casings 4*b* are enlarged in the course of lapse of a time. When the hot-gas is supplied into the cooling pipe 5 in a condition where the cell casings 4*b* have been filled with the ice cubes, the ice making chamber 4 is heated by the hot-gas to release the ice cubes from cell casings 4*b*, and the ice cubes are received by the inclined chute 6 and slip downward on the ice chute 6 to open the shutter 7. Thus, the ice cubes are delivered into an ice storage cabinet (not shown) through the shutter 7.

To manufacture ice making machines of this type in various sizes, it is required to prepare the housing, water storage tank, sprinkler and ice chute in different sizes in accordance with the ice making performance of the machine. Particularly, as the housing is composed of molding parts complicated in construction, the preparation molding dies for each ice making machine causes an increase of the manufacturing cost.

SUMMARY OF THE INVENTION

It is, therefore, a primary object of the present invention to provide an ice making machine of the open-cell type the housing of which can be manufactured at a low cost and assembled in a simple manner.

According to the present invention, the object is accomplished by providing an ice making machine of the open-cell type including a box-type housing, a water storage tank mounted to the bottom of the housing, a sprinkler mounted within the bottom portion of the housing and having a plurality of nozzles for spouting upward ice making water supplied from the water storage tank, and a plurality of ice making cell casings mounted within an ice making chamber formed in an upper portion of the housing and located above the nozzles of the sprinkler to be supplied with the ice making water spouted therefrom, wherein the box-type housing is composed of a pair of spaced side wall panels and front and rear wall panels jointed at their opposite side ends to front and rear end portions of the side wall panels respectively.

In a practical embodiment of the present invention, the side wall panels each are integrally formed with a pair of parallel vertical flanges at their front and rear end portions, wherein the front and rear wall panels are inserted into each vertical slit formed in the vertical flanges at their opposite side ends and fixedly retained in place by engagement with the vertical flanges. In this embodiment, it is preferable that the vertical flanges of the side wall panels each are formed with a latch portion which is located within vertical slit and engaged with a hole formed in each side end portion of the front and rear wall panels.

In another practical embodiment of the present invention, the front and rear wall panels each are integrally formed with a pair of parallel vertical flanges at their opposite side ends, wherein the side wall panels are inserted into each vertical slit formed in the vertical flanges at their front and rear ends and fixedly retained in place by engagement with the vertical flanges. In this embodiment, it is preferable that the vertical flanges of the front and rear wall panels each are formed with a latch portion which is located within the vertical slit and engaged with each hole formed in the front and rear portions of the side wall panels.

BRIEF DESCRIPTION OF THE DRAWINGS

Other objects, features and advantages of the present invention will be more readily appreciated from the following detailed description of preferred embodiments thereof when taken together with the accompanying drawings, in which.

DESCRIPTION OF THE PREFERRED EMBODIMENTS

Figure 1:
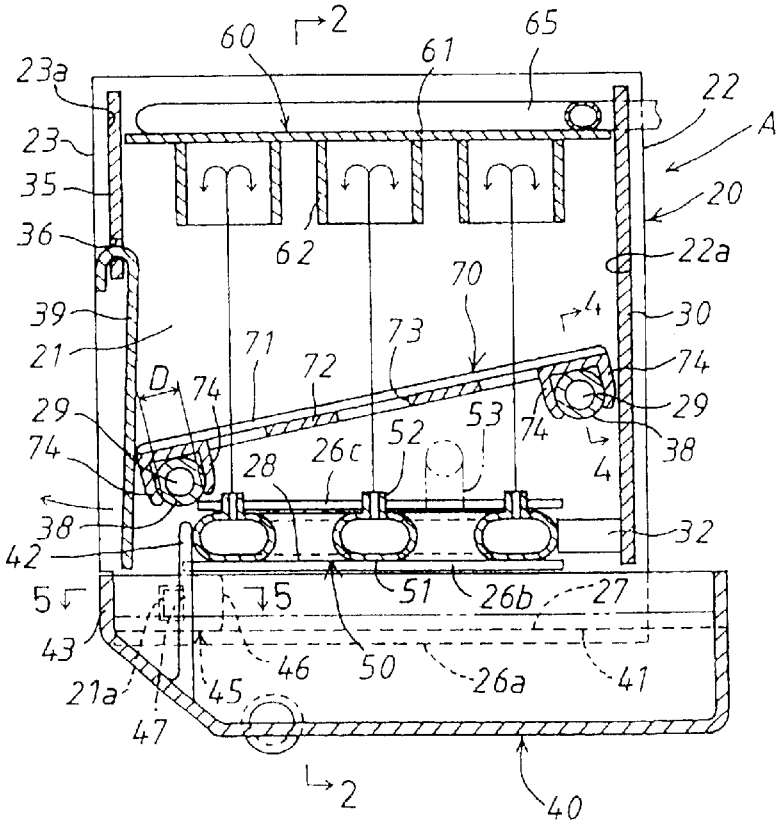
FIG. 1 is a vertical sectional view of an ice making machine in accordance with the present invention.
Figure 2:
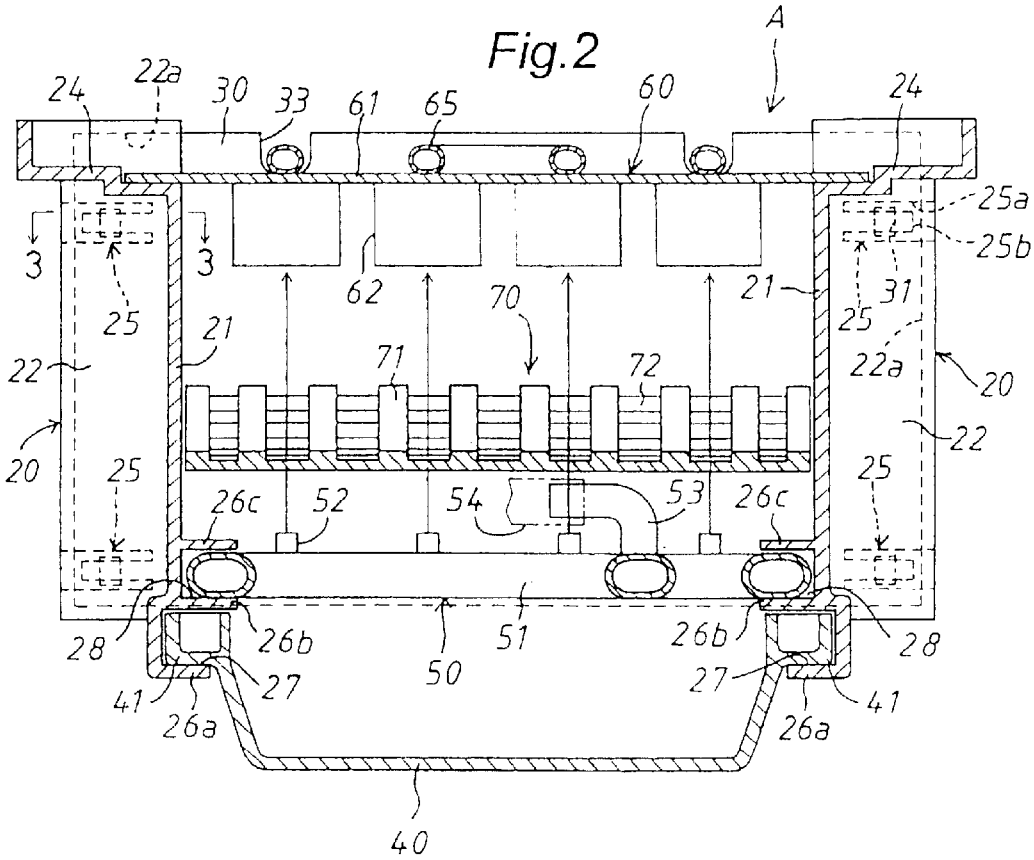
FIG. 2 is a vertical sectional view taken along line 2—2 in FIG. 1.

Illustrated in FIGS. 1 and 2 is an embodiment of an ice making machine of the open-cell type in accordance with the present invention, which is composed of a box-type housing A, a water storage tank 40 mounted to the bottom of housing A, a sprinkler 50 mounted within the bottom portion of housing A, an ice making chamber 60 formed in an upper portion of housing A and an ice chute 70 mounted within the interior of housing A under the ice making chamber 60.

Figure 4:
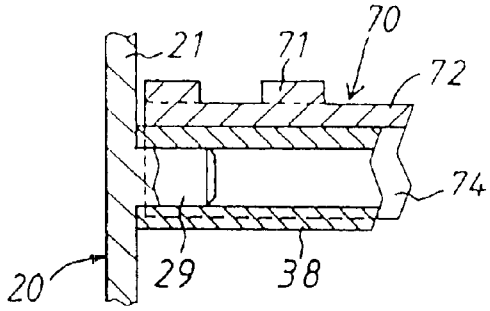
FIG. 4 is a sectional view taken along line 4—4 in FIG. 2.

As clearly shown in FIGS. 1, 2 and FIGS. 6, 7, the box-type housing A is composed of a pair of side wall portions 20 jointed to each other by means of front and rear wall panels 35 and 30. The lower half of front wall panel 35 is opened, and a shutter 39 is suspended from the front wall panel 35 to close the lower half opening. The side wall portions 20 each are in the form of a side wall panel 21 which is integrally formed with a pair of parallel vertical flanges 23 and 22 extended outward at its front and rear ends, an upper lateral flange 24 extended outward at its upper end, a lower lateral rib 26*a* extended inward at its lower end and a pair of parallel lateral ribs 26*b* and 26*c* extended inward at its lower portion. The side wall panels 20 are made of synthetic resin. A support groove 27 for support of the water storage tank 40 is formed between the lower lateral rib 26*a* and lateral ribs 26*b* of side wall panel 21, and a support groove 28 for support of the sprinkler 50 is formed between the parallel lateral ribs 26*b* and 26*c* of side wall panel 21. As shown in FIGS. 1 and 4, the side wall panels 21 each are integrally formed at their internal surfaces with a pair of spaced front columnar projections 29 and a pair of rear columnar projections 29 located above the lateral rib 26*c*. The front columnar projections 29 are located lower than the rear columnar projections 29.

Figure 3:
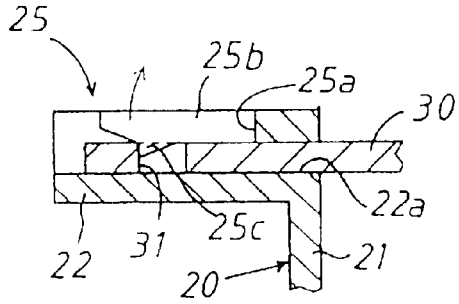
FIG. 3 is a cross-sectional view taken along line 3—3 in FIG. 2.
Figure 6:
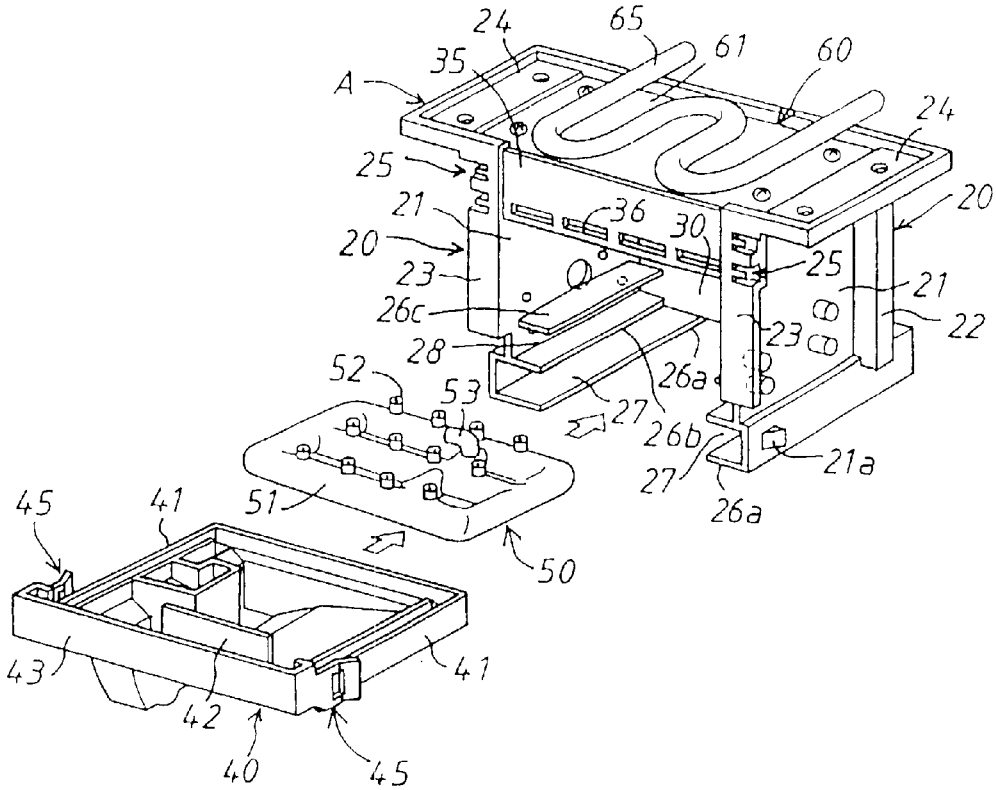
FIG. 6 is a perspective view of the ice making machine in a condition where a sprinkler and a water storage tank have been removed out of the ice making machine.

As shown ill FIGS. 2 and 3, the rear vertical flange 22 of side wall panel 21 has a vertical deep slit 22*a* formed to permit insertion of each side end of rear wall panel 30 and a pair of vertically spaced latch portions 25 provided to retain each side end of rear wall panel 30 by engagement therewith. The latch portions 25 each are composed of a resilient leg 25*b* formed between parallel recesses 25*a* in the vertical flange 22 and a pawl 25*c* of triangle shape in section formed on the resilient leg 25*b* to be projected in the vertical slit 22*a*. Similarly, as shown in FIG. 6, the front vertical flange 23 has a vertical deep slit 23*a* formed to permit insertion of each side end of front wall panel 35 and a pair of vertically spaced latch portions 25 provided to retain each side end of front wall panel 35 by engagement therewith as in the latch mechanisms 25 of rear vertical flange 22.

The rear wall panel 30 is in the form of a rectangular panel of synthetic resin which is formed at its opposite sides with rectangular holes 31 corresponding with the latch portions 25 of rear vertical flanges 22 as shown in FIG. 3. The rear wall panel 30 is inserted into the vertical slits 22*a* of rear vertical flanges 22 at its opposite side ends and retained in place by engagement with the pawls 25*c* of resilient legs 25*b* at its rectangular holes 31. The rear wall panel 30 has a plurality of spaced stoppers 32 formed at its lower portion for engagement with the rear end of sprinkle 50 as shown in FIGS. 1 and 6 and a pair of laterally spaced recesses 33 formed at its upper end for insertion of the cooling pipe 65 as shown in FIG. 2.

The front wall panel 35 is in the form of a rectangular panel of synthetic resin smaller in vertical width than the rear wall panel 30. As in the rear wall panel 30, the front wall panel 35 is inserted into the vertical slits 23*a* of front vertical flanges 23 at its opposite side ends and retained in place by engagement with the pawls of front vertical flanges 23. As shown in FIG. 6, the front wall panel 35 has a plurality of laterally spaced slits 36 formed for suspending the shutter 39 therefrom.

Thus, the box-type housing A is provided by assembling the rear and front wall panels 30 and 35 with the rear and front vertical flanges 22 and 23 of side wall panels 21 as described above. The ice chute 70 is supported on a pair of tubular support rods 38 which are spaced in a fore-and-aft direction of housing A and retained in place by engagement with the columnar projections 29 of side wall panels 21 at their opposite ends as shown in FIG. 1.

The water storage tank 40 is made of synthetic resin and opened at its upper portion. As shown in FIGS. 1 and 2, the water storage tank 40 is formed with a pair of outwardly projected portions 41 extending in parallel along its opposite upper ends. The vertical width of projected portions 41 is slightly smaller than that of the support grooves 27 formed on the lower ends of side wall panels 21. The water storage tank 40 is formed at the front portion of its bottom with an upright thrust member 42. The water storage tank 40 is detachably assembled with the bottom of housing A by engagement with the support grooves 27 of side wall panels 21 at its outwardly projected portions 41 to be movable in the fore-and-aft direction of housing A.

Figure 5:
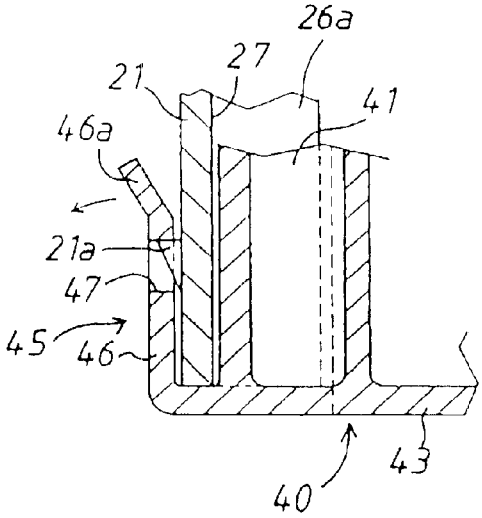
FIG. 5 is a cross-sectional view taken along line 5—5 in FIG. 1.

As shown in FIGS. 1 and 5, the projected portions 41 of water storage tank 40 are provided with latch portions 45 at their front portions. The latch portions 45 each are composed of a pair of resilient legs 46 integrally formed with opposite ends of a front plate 43 of tank 40 as shown in FIG. 5 and a pair of panels 21*a* formed on each lower front end portion of side wall panels 21 to be projected into rectangular holes 47 respectively formed in the resilient legs 46. When the projected portions 41 of water storage tank 40 are inserted into the support grooves 27 of side wall panels 21 from the front of housing A and pushed rearward, the resilient legs 46 of tank 40 are brought into engagement with the pawls 21*a* of side wall panels 21 at their rectangular holes 47 to retain the water storage tank 40 in place at the bottom of housing A. When it is desired to remove the water storage tank 40 out of the housing A, each outward end 46*a* of the resilient legs 46 is moved outward to disengage the resilient legs 46 from the pawls 21*a* of side wall panels 21. With such operation, the water storage tank 40 can be removed from the bottom of housing A.

As shown in FIGS. 1, 2 and 6, the sprinkler 50 is composed of three parallel flattened conduits 51 connected with each other by means of a pair of side conduits, a plurality of nozzles 52 provided on the flattened conduits 51 and a water supply port 53 provided on one of the side conduits as shown in FIG. 6. The component parts of sprinkler 50 are integrally made of synthetic resin in entirety The vertical width of sprinkler 50 is smaller than that of the support groove 28 formed between the parallel lateral ribs 26*b* and 26*c* of each side wall panel 21. In the assembly process of sprinkler 50, the side conduits of sprinkler 50 are inserted into the support grooves 28 from the front of housing A and positioned in place by abutment against the stoppers 32 formed on the rear wall 30 as shown in FIG. 1. Thus, the sprinkler 50 is retained in place by engagement with the upright thrust members 42 formed on the bottom of water storage tank 40.

Figure 8:
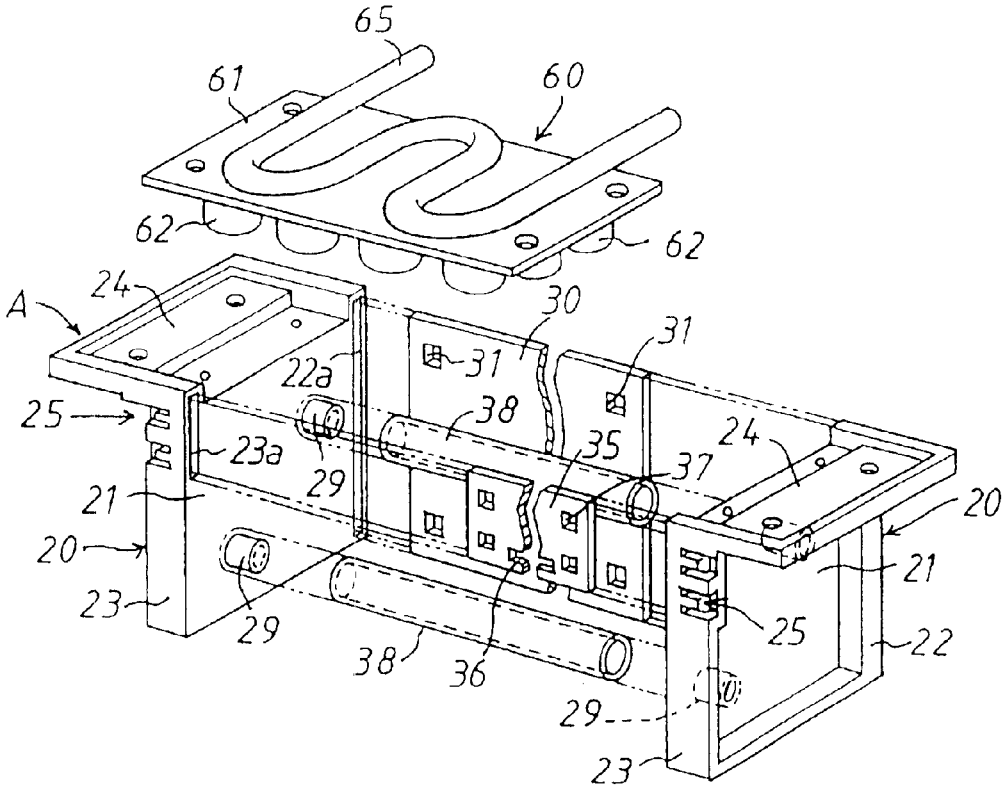
FIG. 8 is a perspective view illustrating a disassembled condition of a housing of the ice making machine.
Figure 9:
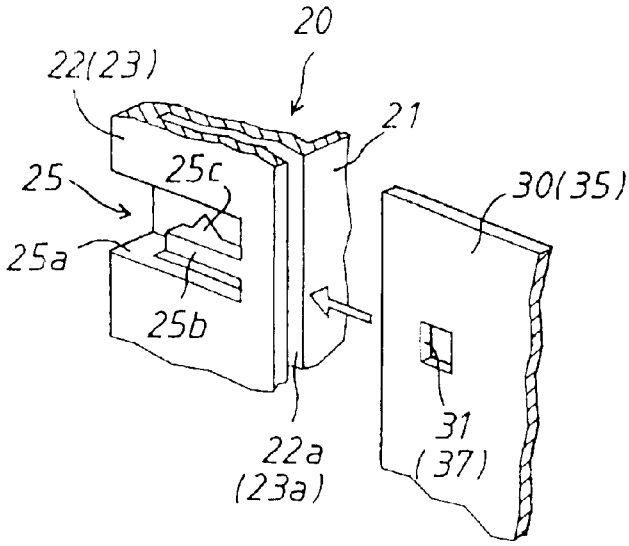
FIG. 9 is a perspective view illustrating a disassembled condition of a joint portion of a rear wall panel and a side wall panel shown in FIG. 8.

As shown in FIGS. 1, 2 and 8, the ice making chamber 60 is formed to contain a plurality of ice making cell casings 62 welded to the bottom surface of a flat base plate 61 and opened downward. The ice making cell casings 62 each are in the form of a piece of cut pipe and located above each nozzle 52 of sprinkler 50. The base plate 61 and cell casings 62 are made of copper or aluminum superior in heat conductivity. A cooling pipe 65 is meanderingly secured on the base plate 61 and located above each center of cell casings 62. The cooling pipe 65 is connected to a refrigerant conduit to be supplied with refrigerant from a freezing circuit as in the conventional ice maker shown in FIGS. 11 and 12. In the ice making chamber 60, as shown in FIGS. 2 and 8, the flat base plate 61 is mounted on a pair of support brackets 24 formed on the upper ends of side wall panels 21 and fixed in place by fastening screws.

Figure 7:
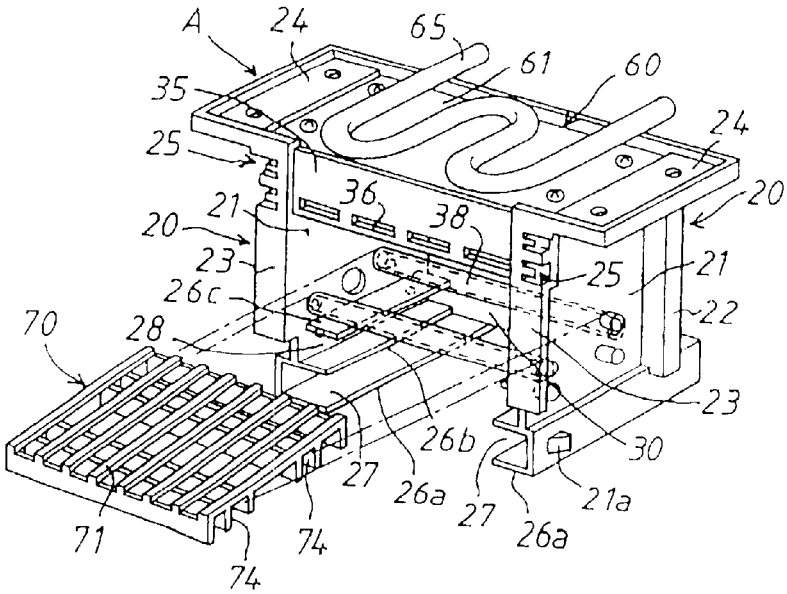
FIG. 7 is a perspective view of the ice making machine in a condition where an ice chute has been removed out of the ice making machine.

As shown in FIGS. 1, 2 and 7, the ice chute 70 is composed of a plurality of spaced slide plates 71 arranged in the fore-and-aft direction of housing A and connected by a plurality of spaced lateral plates 72 in the form of a lattice. The ice chute 70 has a pair of spaced parallel support legs 74 provided at its front and rear portions for engagement with the tubular support rods 38. The support legs 74 of ice chute 70 each are formed with a pair of resilient leg segments spaced in width D slightly smaller than the outer diameter of support rod 38. The component parts of ice chute 70 are integrally made of synthetic resin in entirety. In the assembly process of the ice chute 70, the support legs 74 of ice chute 70 are resiliently engaged with the tubular support rods 38 in such a manner that the ice chute 70 is inclined forward in the housing A.

In operation of the ice maker, the ice making chamber 60 is cooled by refrigerant supplied into the cooling pipe 65 from the freezing circuit, and the ice making water in tank 40 is supplied into the sprinkler 50 by operation of a water pump mounted to the bottom of tank 40 through a hose 54. The ice making water is spouted upward from each nozzle 52 of sprinkler 50 through openings of ice chute 70 and brought into contact with the internal surface of each ice making cell casing 62 cooled by the refrigerant. Thus, the ice making water is partly frozen in each cell casing 62, and a remainder of the water is returned into the water storage tank 40 and supplied again into the sprinkler 50. The ice cubes formed in the cell casings 62 are enlarged in the course of lapse of a time. When hot-gas is supplied into the cooling pipe 65 in a condition where the cell casings 62 have been filled with the ice cubes, the ice making chamber is heated by the hot-gas to release the ice cubes from cell casings 62, and the ice cubes are received by the inclined ice chute 70 and slip downward on the ice chute 70 to open the shutter 39. Thus, the ice cubes are delivered into an ice storage cabinet (not shown) through the shutter 39.

When it is desired to remove the water storage tank 40 for cleaning, the outward ends 46*a* of resilient legs 46 are moved outward to disengage the resilient legs 46 from the pawls 21*a* of side walls 21. With this operation, as shown in FIG. 6, the water storage tank 40 can be pulled out of the support grooves 27 formed in the projected portions 41 of side wall panels 21. When the water storage tank 40 is removed out of the bottom of housing A, the upright rust member 42 formed on the bottom tank 40 is removed from the sprinkler 50. Thus, the sprinkler 50 can be pulled out of the support grooves 28 of side wall panels 21. When it is desired to assembly the water storage tank 40 and sprinkler 50 with the bottom portions of housing A, the sprinkler 50 is first inserted into the support grooves 28 of side wall, panels 21 from the front of housing A. Thereafter, the water storage tank 40 is inserted into the support grooves 27 of side wall panels 21 and retained in place by engagement with the pawls 21*a* of side walls 21 at its resilient legs 46 when it has been inserted into the innermost ends of support grooves 27. In such an instance, the sprinkler 50 is positioned in place by engagement with the upright thrust member 42 formed on the bottom of tank 40. As the water storage tank 40 and sprinkler 50 can be detachably assembled with the side wall panels 21 of housing A in a simple manner, it is able to wash the tank 40 and sprinkler 50 for maintaining them in a clean condition and for preventing clog of the sprinkler 50 at its nozzles 52.

To remove the ice chute 70 out of the interior of housing A, the front support leg 74 of ice chute 70 is disengaged upward from the front support rod 38, and the rear support leg 74 of ice chute 70 is disengaged upward from the rear support rod 38. Thus, as shown in FIG. 7, the ice chute 70 can removed out of the interior of housing A. For mounting the ice chute 70 within the housing A, the front and rear support leg 74 of ice chute 70 are resiliently engaged with the front and rear support rods 38 to retain the ice chute in an inclined position. With such operation, the ice chute 70 can be detachably assembled within the housing A in a simple manner to be maintained in a clean condition, To manufacture the ice making machine of the open-cell type in various sizes, it is required to prepare the housing, water storage tank, sprinkler, ice making chamber and ice chute in different sizes in accordance with the ice making performance of the ice making machine. Particularly, as the housing is composed of molding parts complicated in construction, the preparation of molding dies for each ice maker housing causes an increase of the manufacturing cost. To solve such problem, the box-type housing A in this embodiment is composed of the front and rear wall panels 35 and 30 assembled with the pair of side wall panels 21. Accordingly, the side wall panels 21 formed with the vertical flanges 22 and 23 complicated in construction can be used as common parts in the case that the front and rear wall panels 35 and 30 adjusted in lateral width are assembled to provide box-type housings A in different size for use in ice making machines of different ice making performance. As a result, ice making machines of this type can be manufactured in various sizes at a low cost.

Figure 10:
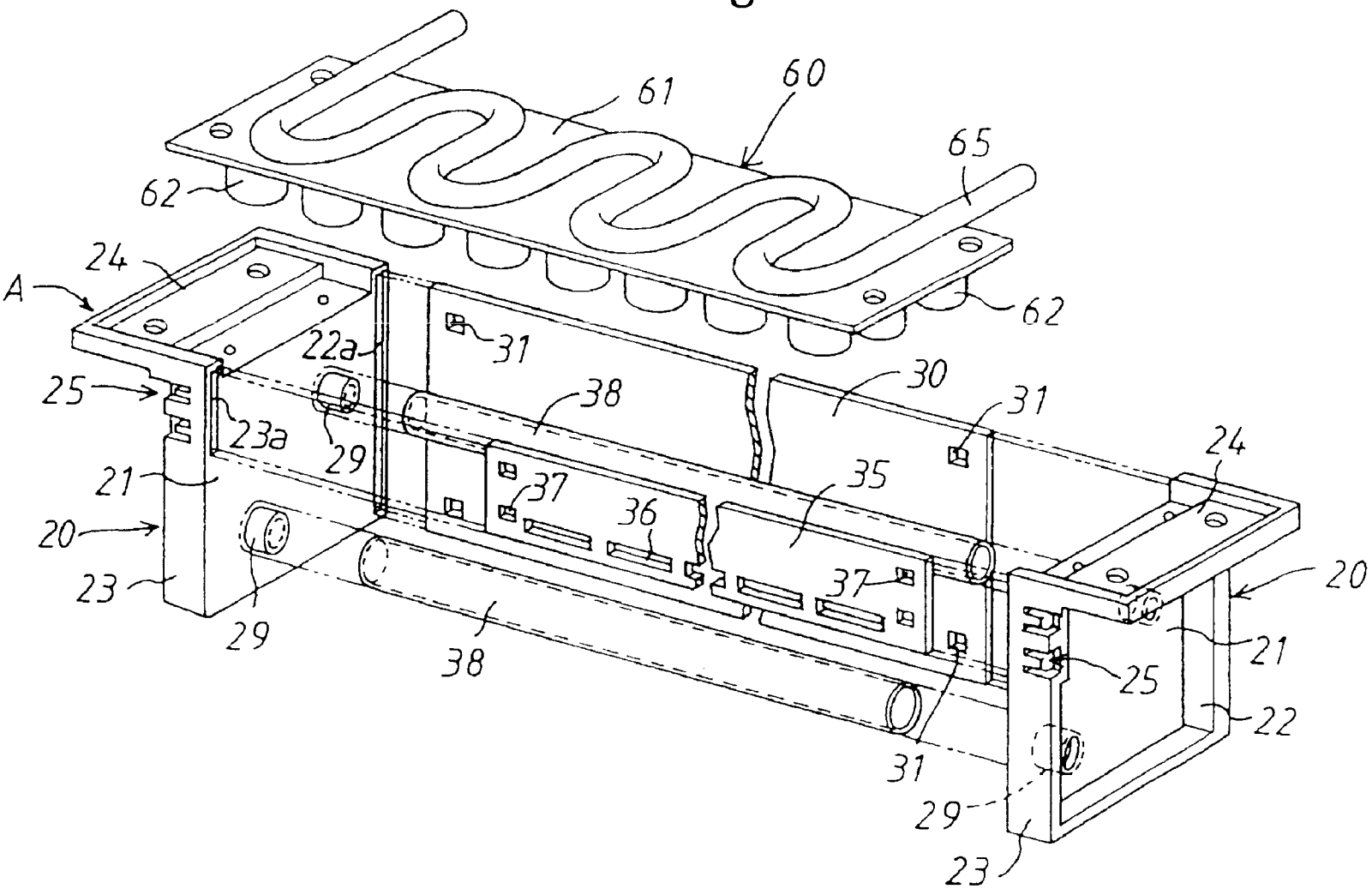
FIG. 10 is a perspective view illustrating a disassembled condition of the ice making machine in a condition where the lateral width of the ice making machine has been enlarged.

Illustrated in FIG. 10 is an ice making machine of the open-cell type the size of which is twice of the ice making machine in the embodiment described above, wherein the front and rear wall panels 35 and 30 are enlarged twice in lateral width and assembled with the side wall panels 21, and wherein the ice making chamber 60 and support rods 38 of the ice chute 70 are also enlarged in lateral width. The other construction and parts of the ice making machine are substantially the same as those of the ice making machine in the embodiment, except for each size of them.

In the embodiment described above, the side wall panels 21 each are integrally formed with the front and rear lateral vertical flanges 23 and 22 which are formed therein with the vertical deep slits 23*a* and 22*a* respectively to permit insertion of each side end of the front and rear wall panels 35 and 30. Thus, in the case that the vertical deep slits 23*a* and 22*a* each are enlarged in depth, the joint precision and strength of the front and rear wall panels 35 and 30 to the side wall panels 21 can be increased to enhance the strength of the box-type housing A.

Although in the embodiment, the rear wall panel 30 is inserted into the vertical deep slits 22*a* of rear vertical flanges 22 of each side wall panel 21 at its opposite side ends and retained in place by engagement with the pawls 25*c* of resilient legs 25*b* of rear vertical flanges 22 at its rectangular holes 31, while the front wall panel 35 is inserted into the vertical deep slits 23*a* of front vertical flanges 23 of each side wall panel 21 at its opposite side ends and retained in place by engagement with the pawls of the resilient legs of front vertical flanges 23, the rear and front wall panels 30 and 35 may be adhered at their opposite side ends to the rear and front vertical flanges 22 and 23.

Figure 11:
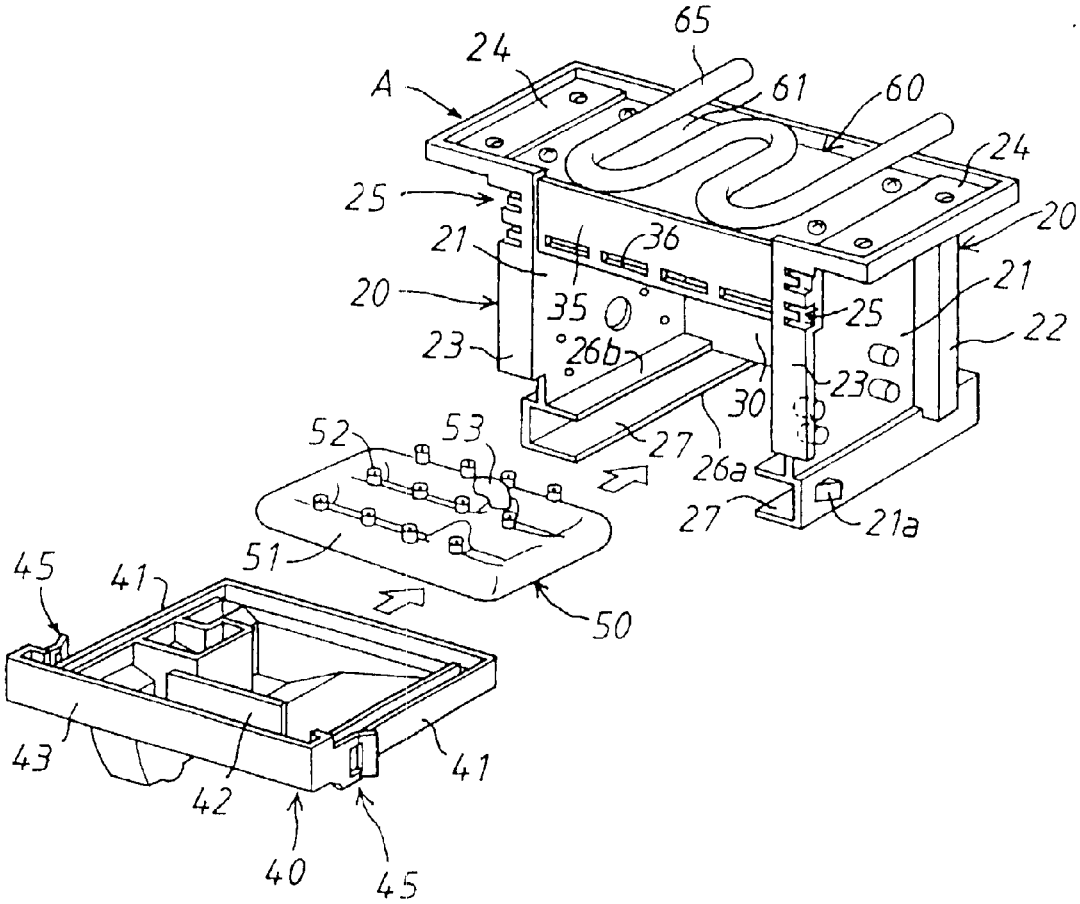
FIG. 11 is a perspective view illustrating a disassembled condition of a modification of the ice making machine.

Although in the embodiment, the side wall panels 21 each are provided at their low end portions with parallel lateral ribs 26*a*, 26*b* and 26*c* to form the support grooves 27 and 28 for support of the water storage tank 40 and sprinkler 50 as shown in FIG. 6, the upper lateral rib 26*c* may be removed as shown in FIG. 11. In such a case, the water storage tank 40 is detachably assembled with the bottom of housing A by engagement with the support grooves 27 of side wall panels 21 at its outwardly projected portions 41 to be movable in the fore-and-aft direction of housing A, while the sprinkler 50 is mounted on the lateral rib 26*b* and positioned in place by weight of its self.

Figure 12:
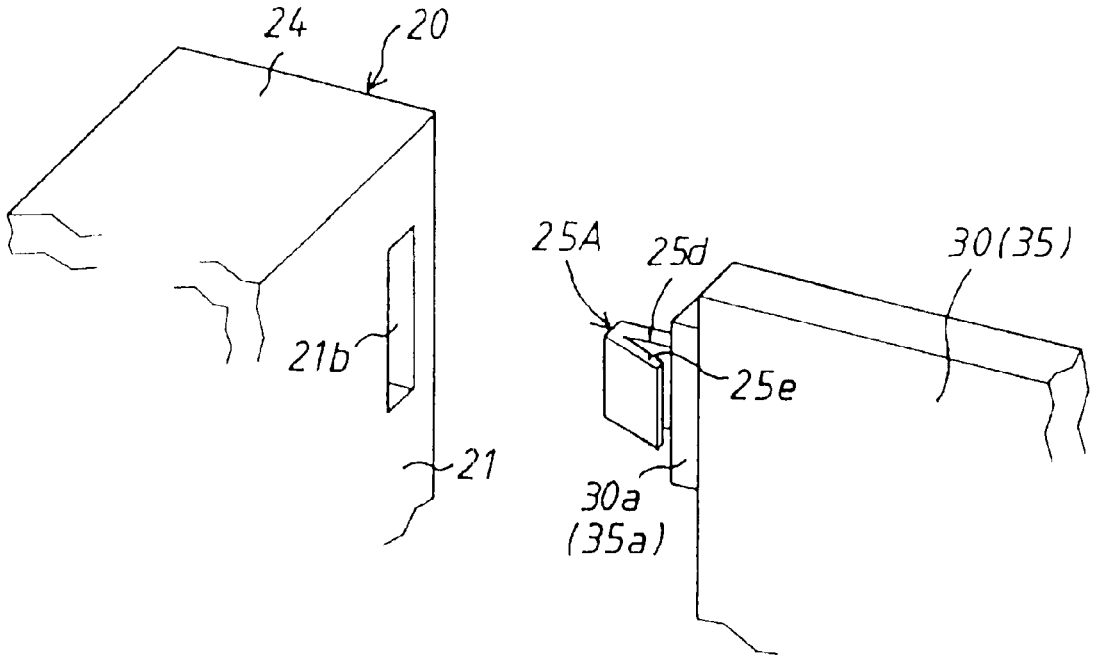
FIG. 12 is a perspective view illustrating a disassembled condition of a first modification of the joint portion of the rear wall panel and side wall panel shown in FIG. 8.
Figure 13:
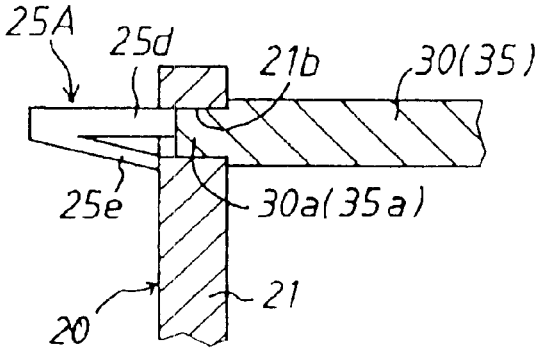
FIG. 13 is a cross-sectional view of an assembled condition of the joint portion shown in FIG. 12.

Illustrated in FIGS. 12 and 13 is a first modification of the joint portion of the rear wall panel 30 to the side wall panel 21, wherein the rear wall panel 30 is formed at its opposite side ends with a rectangular block 30*a*, and wherein a latch portion 25A is provided on the rectangular block 30*a*. The latch portion 25A is composed of a resilient support leg 25*d* extended from the rectangular block 30*a* and a pawl 25*e* integral with the support leg 25*d*. On the other hand, the side wall panels 21 each are formed at their rear end portions with a rectangular hole 21*b* which corresponds with the rectangular block 30*a* of rear wall panel 30. The rectangular block 30*a* is provided on the upper and low portions of rear wall panel 30, and the rectangular hole 21*b* is formed in the upper and lower portions of side wall panel 21 respectively at a position corresponding with the rectangular block 30*a* of rear wall panel 30. Similarly, the same rectangular block and latch portion as in the rear wall panel 30 are formed on the opposite side ends of front wall panel 35, and the side wall panels 21 each are formed at their front ends with the same rectangular hole corresponding with the rectangular block of front wall panel 35. In the assembly process of the front and rear wall panels 35 and 30 with the side wall panels 21, the latch portion 25A and rectangular block 30*a* of rear wall panel 30 are inserted into the rectangular hole 21*b* of side wall panel 21 so that the rectangular block 30*a* is coupled with the rectangular hole 21*b* and that the pawl 25*e* of latch portion 25A is resiliently engaged with the outer surface of side wall panel 21 as shown in FIG. 13 to fixedly joint the rear wall panel 30 with the side wall panel 21. Similarly, the latch portion and rectangular block of front wall panel 35 are inserted into the corresponding rectangular hole of side wall panel 21 so that the rectangular block is coupled with the rectangular hole and that the pawl of latch portion 25A is resiliently engaged with the outer surface of side wall panel 21 to fixedly joint the front wall panel with the side wall panel 21.

Figure 14:
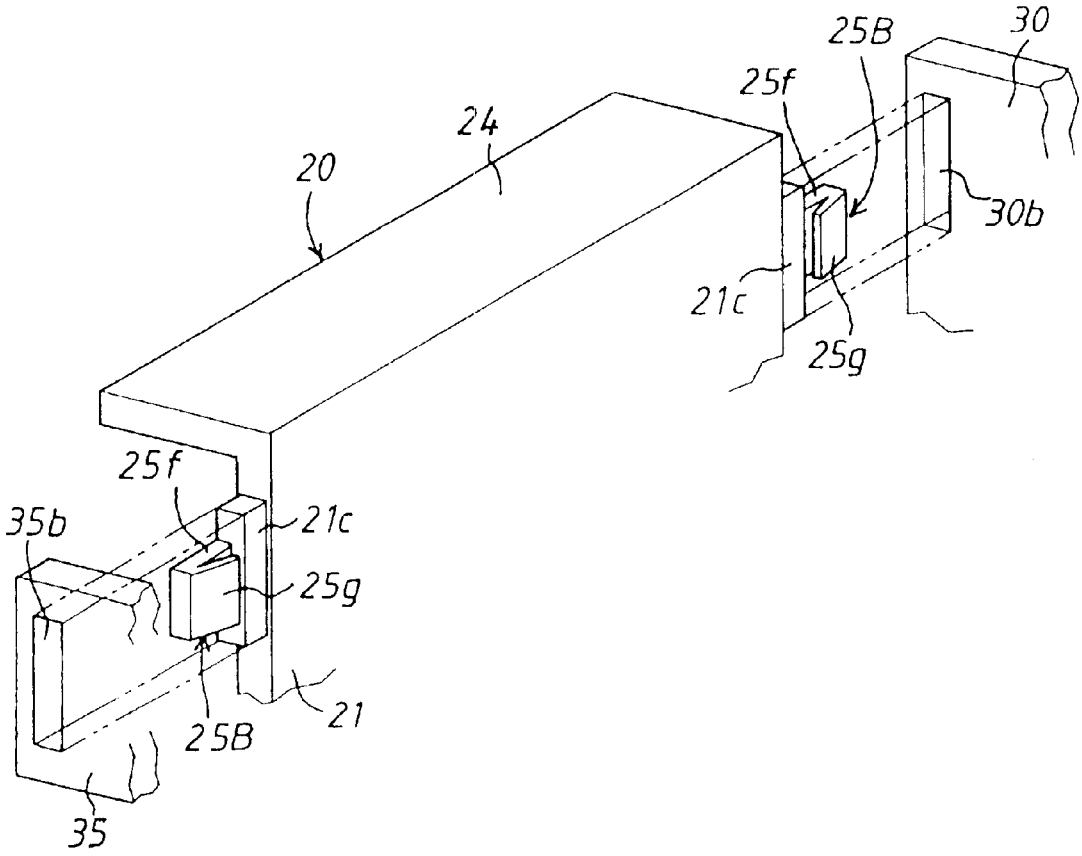
FIG. 14 is a perspective view illustrating a disassembled condition of a second modification of the joint portion of the rear wall panel and side wall panel shown in FIG. 8.

Illustrated in FIG. 14 is a second modification of the joint portions of the front and rear wall panels 35 and 30 to the side wall panels 21, wherein a rectangular block 21*c* and a latch portion 25B are formed on the front end of side wall panel 21, while a pair of vertically spaced rectangular blocks 21*c* and latch portions 25B are formed on the rear end of side wall panel 21 at its upper and low portions. The latch portions 25B each are composed of a resilient support leg 25*f* extended from the rectangular block 21*c* and a pawl 25*g* integral with the support leg 25*f* as in the first modification. In this modification, the rear wall panel 30 is formed at its opposite side end portions with rectangular holes 30*b* which correspond with the rectangular blocks 21*c* of side wall panel 21, while the front wall panel 35 is formed at its opposite side end portions with a rectangular hole 35*b* which corresponds with the rectangular block 21*c* of side wall panel 21. In the assembly process of the front and rear wall panels 35 and 30 with the side wall panels 21, the rectangular block 21*c* and latch portion 25B formed on the front end of side wall panel 21 are inserted into the corresponding rectangular hole 35*b* of front wall panel 35 so that the rectangular block 21*c* is coupled with the corresponding rectangular hole 35*b* and that the pawl 25*g* of latch portion 25B is resiliently engaged with the outer surface of the front wall panel 35 to fixedly joint the front wall panel 35 with the front end of side wall panel 21. On the other hand, the rectangular blocks 21*c* and latch portions 25B formed on the rear end of side wall panel 21 are inserted into the corresponding rectangular holes 30*b* of rear wall panel 30 so that the rectangular blocks 21*c* are coupled with, the corresponding rectangular holes 30*b* and that the pawls 25*g* of latch portions 21*c* are resiliently engaged with the outer surface of rear wall panel 30 to fixedly joint the rear wall panel 30 with the rear end of side wall panel 21.

Figure 15:
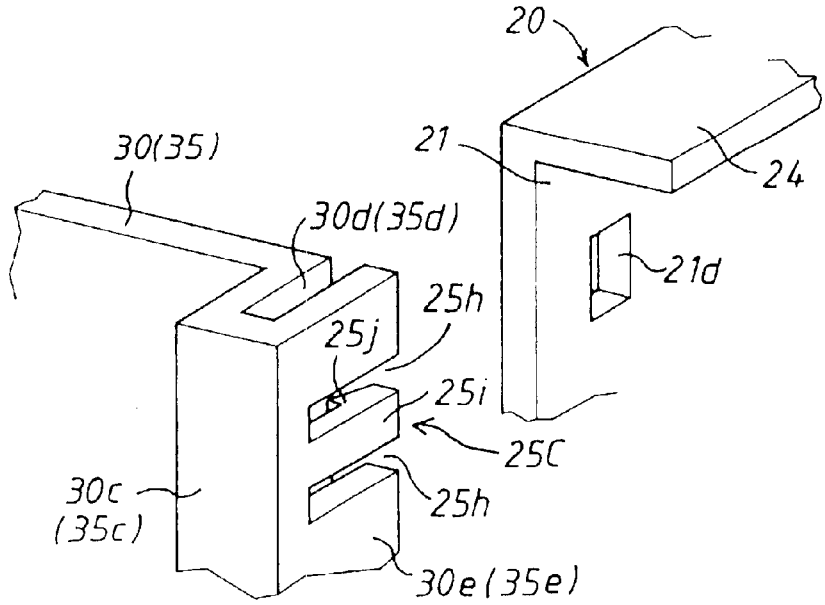
FIG. 15 is a perspective view illustrating a disassembled condition of a third modification of the joint portion of the rear wall panel and side wall panel shown in FIG. 8.

Illustrated in FIG. 15 is a third modification of the joint portion of the front and rear wall panels 30 to the side wall panel 21, wherein the rear wall panel 30 is integrally formed at its opposite side ends with a pair of vertical flanges 30*c* which are respectively provided with a vertical deep slit 30*d* formed to permit insertion of each rear end of the side wall panels 21. The vertical flanges 30*c* each are provided at their outside portions 30*e* with a pair of vertically spaced latch portions 25C which are located at the upper and lower portions of rear wall panel 30. The latch portions 25*c* each are composed of a resilient leg 25*i* formed between a pair of slits 25*h* and a pawl. 25*j* integral with the resilient leg 25*i*. The pair of slits 25*h* are formed at the upper and lower portions of vertical flange 30*c*. Similarly, the front wall panel 35 is provided at its opposite side ends with the same vertical flanges 35*c* as those of the rear wall panel 30. In this modification, the side wall panels 21 each are formed at their rear end portions with a pair of vertically spaced rectangular holes 21*d* which correspond with the latch portions 25C of rear wall panel 30. The side wall panels 21 each are also formed at their front end portions with a rectangular hole which corresponds with the latch portion 25*c* of front wall panel 35. In the assembly process of the front and rear wall panels 35 and 30 with the side wall panels 21, each, rear end portion of the side wall panels 21 is inserted into each vertical slit 30*d* of vertical flanges 30*c* formed on the opposite side ends of rear wall panel 30 so that each pawl 25*j* of vertical flanges 30*c* is resiliently engaged with each corresponding rectangular hole 21*d* of side wall panels 21 to fixedly joint the rear wall panel 30 with the side wall panel 21. Similarly, each front end portion of the side wall panels 21 is inserted into each vertical slit (35*d*) of vertical flanges (35*c*) formed on the opposite side ends of front wall panel 35 so that each pawl of the vertical flanges is resiliently engaged with each corresponding rectangular hole of the side wall panels 21 to fixedly joint the front wall panel 35 with the side wall panel 21.

Figure 16:
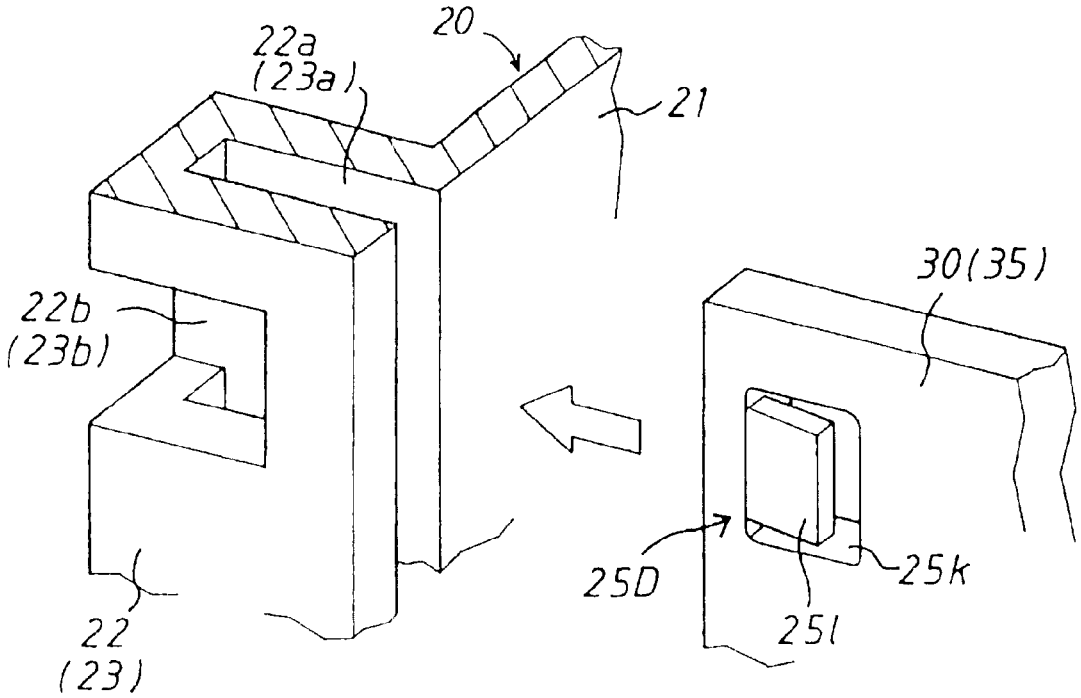
FIG. 16 is a perspective view illustrating a disassembled condition of a fourth modification of the joint portion of the rear wall panel and side wall panel shown in FIG. 8.
Figure 17:
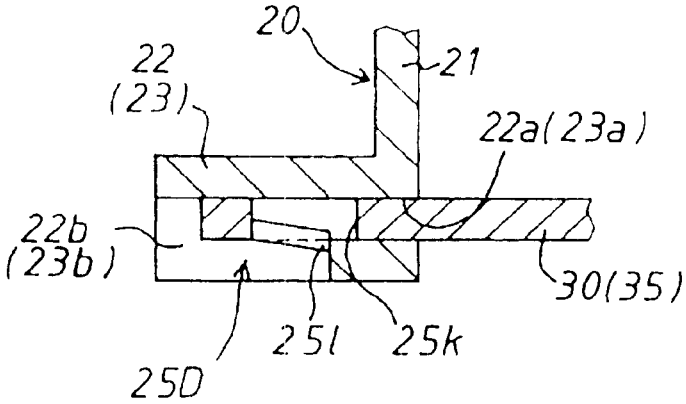
FIG. 17 is a cross-sectional view of an assembled condition of the joint portion shown in FIG. 16.
Figure 18:
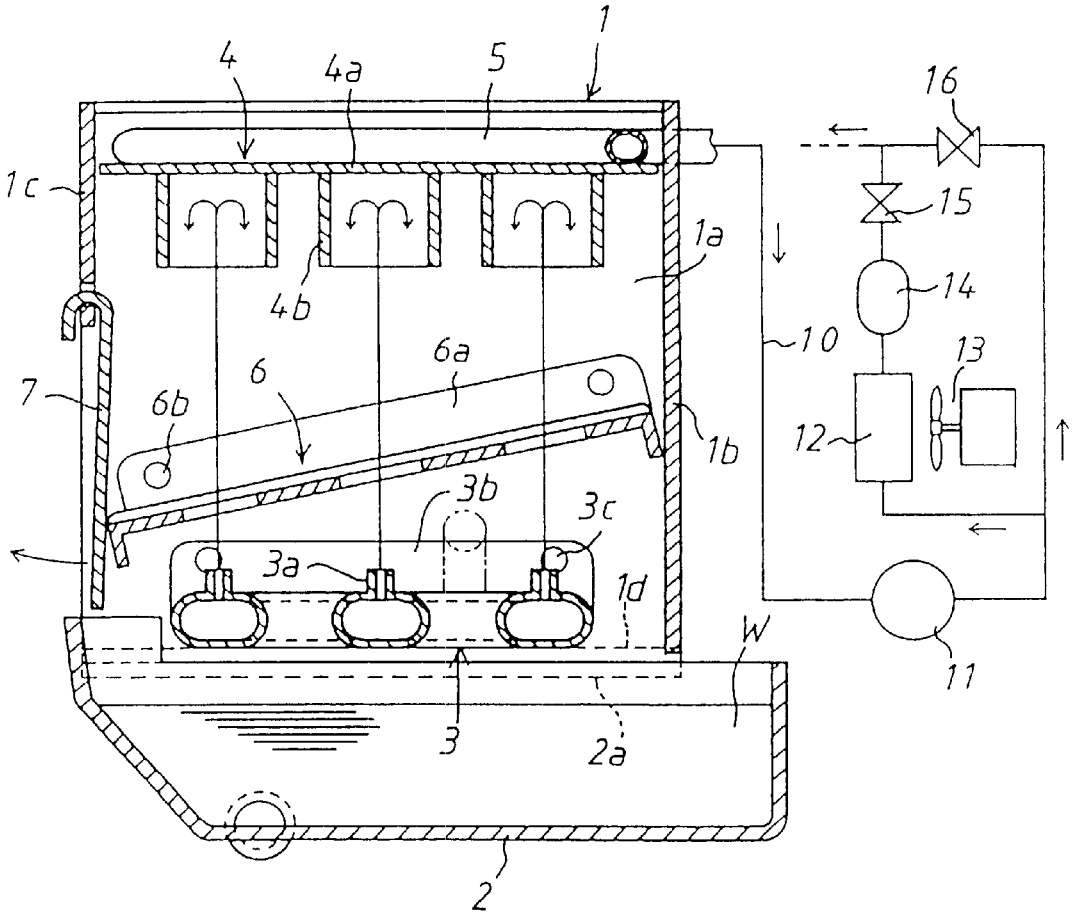
Fig. 18 PRIOR ART
FIG. 18 is a vertical sectional view of a conventional ice making machine.

Illustrated in FIGS. 16 and 17 is a fourth modification of the joint portion of the rear wall panel 30 with the side wall panels 21, wherein the opposite side ends of rear wall panel 30 are inserted into a vertical deep slit 22*a* formed in each rear vertical flange 22 of side wall panels 21 and fixedly retained in the vertical deep slit 22*a*. In this modification, the rear wall panel 30 is provided at each side end portion thereof with a pair of vertically spaced latch portions 25D which are located at the upper and lower portions of rear wall panel 30. The latch portions 25D each are composed of a pawl 25*l* provided within a rectangular hole 25*k* formed in each side end portion of the rear wall panel 30. On the other hand the rear vertical flange 22 of side wall panel 21 is formed with a cut out portion 22*b* at a position corresponding with each latch portion 25D of rear wall panel 30. Similarly, the front wall panel 35 is provided at each side end thereof with the same latch portion as those of rear wall panel 30, and the front vertical flange 23 formed on each front end of the side wall panels 21 is formed with the same vertical deep slit and cut out portion as those of the vertical flange 22 shown in FIG. 16. In the assembly process of the front and rear wall panels 35 and 30 with the side wall panels 21, each side end portion of the rear wall panel 30 is inserted into the vertical deep slit 22*a* of the vertical flange 22 formed on each rear end of side wall panels 21 so that the pawl 25*l* of the latch portion 25D is resiliently engaged with the cut out portion 22*b* of vertical flange 22 to fixedly joint the rear wall panel 30 with the side wall panels 21. Similarly; each side end portion of the front wall panel 35 is inserted into the corresponding vertical deep slit (23*a*) of the vertical flange (23) formed on each front end of side wall panels 21 so that the pawl of the latch portion is resiliently engaged with the cut out portion (23*b*) of the vertical flange (23) to fixedly joint the front wall panel 35 with the side wall panels 21.

From the above description, it will be understood that as in the ice making machine of the present invention, the box-type housing A is composed of the front and rear wall panels 35 and 30 assembled with the side wall panels 21, the side wall panels 21 formed with the vertical flanges 22 and 23 complicated in construction can be used as common parts in the case that the front and rear wall panels 35 and 30 are adjusted in lateral width and assembled with the side wall panels 21 to provide box-type housings in different size for use in ice making machines of different ice making performance. As a result, ice making machines of this type can be manufactured in various sizes at a low cost.

What is claimed is:

1. An open-cell ice making machine, comprising:

a box shaped housing;

a water storage tank mounted to a bottom of the housing;

a sprinkler mounted within a bottom portion of the housing and having a plurality of nozzles for spouting ice making water supplied from the water storage tank in an upward direction; and a plurality of ice making casings mounted within an ice making chamber formed in an upper portion of the housing, the plurality of casings being located above the nozzles of the sprinkler and are supplied with the ice making water spouted from the nozzles, wherein the housing comprises:

a pair of laterally spaced side wall panels; and front and rear wall panels jointed at opposite side ends to front and rear end portions of the side wall panels, wherein each side wall panel has a pair of parallel vertical flanges extending outward from the front and rear end portions of the side wall panels, each vertical flange includes a vertical slit and a pair of vertically spaced latch portions located in the vertical slit, and wherein the opposite side ends of the front and rear wall panels are inserted into the vertical slits of the vertical flanges and detachably retained therein by the opposite side ends of the front and rear wall panels, respectively, being engaged by the latch portions of the vertical flanges.

2. The ice making machine according to claim 1, wherein each latch portion includes a resilient leg formed between parallel recesses formed in the vertical flange and a pawl formed on the resilient leg, the pawl detachably engaging a corresponding hole formed in the opposite side ends of the front and rear wall panels.

3. The ice making machine according to claim 1, wherein a bottom portion of each side wall panel has an upper lateral flange extending outward from an and to support a base plate of the ice making cell casings.

4. The ice making machine according to claim 1, wherein a bottom portion of each side wall panel has first and second parallel support grooves formed therein and extending in a fore-and-aft direction of the housing, wherein the first support groove supports the water storage tank and the second support groove supports the sprinkler.

5. The ice making machine according to claim 1, further comprising a lattice shaped ice chute extending in a fore-and-aft direction within an interior of the housing and under the ice making casings, the ice chute being detachably mounted on a set of spaced support rods fixed to the side wall panels, wherein a bottom portion of each side wall panel has first and second parallel support grooves formed therein and extending in a fore-and-aft direction of the housing, wherein the first support groove supports the water storage tank and the second support groove supports the sprinkler.

6. An open-cell ice making machine, comprising:

a box shaped housing;

a water storage tank mounted to a bottom of the housing;

a sprinkler mounted within a bottom portion of the housing and having a plurality of nozzles for spouting ice making water supplied from the water storage tank in an upward direction; and a plurality of ice making casings mounted within an ice making chamber formed in an upper portion of the housing, the plurality of casing being located above the nozzles of the sprinkler and are supplied with the ice making water spouted from the nozzles, wherein the housing comprises:

a pair of laterally spaced side wall panels; and front and rear wall panels jointed at opposite side ends to front and rear end portions of the side wall panels, wherein the front and rear end portions of each side wall panel has a pair of vertically spaced holes formed therein, wherein the opposite side ends of each front and rear wall panel is formed with a pair of vertically spaced projections that couple with the vertically spaced holes of the side wall panels, wherein a pair of latch portions are integrally formed on the vertically spaced projections, and wherein each pair of latch portions are maintained in engagement with the side wall panels in a state where each pair of the vertically spaced projections of the front and rear wall panels have been coupled with corresponding vertically spaced holes formed in the vertical flanges.

7. An open-cell ice making machine, comprising:

a box shaped housing;

a water storage tank mounted to a bottom of the housing;

a sprinkler mounted within a bottom portion of the housing and having a plurality of nozzles for spouting ice making water supplied from the water storage tank in an upward direction;

a plurality of ice making casings mounted within an ice making chamber formed in an upper portion of the housing, the plurality of casings being located above the nozzles of the sprinkler and are supplied with the ice making water spouted from the nozzles; and an ice chute mounted within an interior of the housing under the ice making casings, wherein the housing comprises:

a pair of laterally spaced side wall panels and front and rear wall panels jointed at opposite side ends to front and rear end portions of the side wall panels, wherein the front and rear end portions of each side wall panel has a pair of outward extending parallel vertical flanges, each vertical flange being formed therein with a vertical slit and a pair of vertically spaced cut out portions located in the vertical slit, wherein the opposite side ends of each front and rear wall panel is formed with a pair of vertically spaced latch portions that engage the cut out portions of respective vertical flanges, and wherein the latch portions of the opposite side ends of the front and rear wall panels are inserted into the vertical slits of the vertical flanges and detachably retained therein by engaging the cut out portions of the vertical flanges.

8. An ice making machine of the open-cell type including a box-type housing, a water storage tank mounted to the bottom of the housing, a sprinkler mounted within the bottom portion of the housing and having a plurality of nozzles for spouting upward ice making water supplied from the water storage tank, and a plurality of ice making cell casings mounted within an ice making chamber formed in an upper portion of the housing and located above the nozzles of the sprinkler to be supplied with ice making water spouted therefrom, wherein the box-type housing includes a pair of spaced side wall panels and front and rear wall panels, each of the side wall panels are formed with front and rear end portions and the front and rear wall panels are formed with opposing side ends, and wherein either the front and rear end portions of the side wall panels or the opposing side ends of the front and rear wall panels each have a vertical slit formed therein and the other of the front and rear end portions of the side wall panels or the opposing side ends of the front and rear wall panels are inserted into the vertical slits, respectively.

* * * * *